United States Patent [19]

Asher

[11] 4,319,099

[45] Mar. 9, 1982

[54] DOME SWITCH HAVING CONTACTS OFFERING EXTENDED WEAR

[75] Inventor: James C. Asher, San Jose, Calif.

[73] Assignee: Atari, Inc., Sunnyvale, Calif.

[21] Appl. No.: 227,321

[22] Filed: Jan. 22, 1981

Related U.S. Application Data

[63] Continuation of Ser. No. 35,678, May 3, 1979, abandoned.

[51] Int. Cl.[3] ..... H01H 13/70

[52] U.S. Cl. ..... 200/5 A; 200/159 B; 200/275; 200/302

[58] Field of Search ..... 200/5 A, 6 A, 159 B, 200/302, 275

[56] References Cited

U.S. PATENT DOCUMENTS

| | | | |
|---|---|---|---|
| Re. 29,440 | 10/1977 | Durkee et al. | 200/5 A |
| 3,749,859 | 7/1973 | Webb et al. | 200/5 A X |
| 3,806,673 | 4/1974 | Boulanger | 200/5 A |
| 3,996,429 | 12/1976 | Chu et al. | 200/5 A |
| 4,029,915 | 6/1977 | Ojima | 200/6 A X |
| 4,033,030 | 7/1977 | Robinson | 200/5 A X |
| 4,085,306 | 4/1978 | Dunlap | 200/5 A |
| 4,124,787 | 11/1978 | Aamoth et al. | 200/6 A |
| 4,163,125 | 7/1979 | Boulanger | 200/5 A |

FOREIGN PATENT DOCUMENTS

| | | | |
|---|---|---|---|
| 1486051 | 9/1977 | United Kingdom | 200/5 A |

*Primary Examiner*—James R. Scott

*Attorney, Agent, or Firm*—Townsend and Townsend

[57] ABSTRACT

An improved dome switch is disclosed in which the configuration of the dome is modified to avoid premature wear of the circular contact. Specifically, the marginal portions of the dome is physical contact with the circular contact are provided with reverse curvature relative to the curvature of the remainder of the dome. The dome switch is incorporated in devices in which the switch is mechanically actuated, such as in a video game joy stick, or manually actuated, such as in the keyboard of a hand-held calculator.

6 Claims, 6 Drawing Figures

DOME SWITCH HAVING CONTACTS OFFERING EXTENDED WEAR

This is a continuation of application Ser. No. 35,678, filed May 3, 1979, now abandoned.

BACKGROUND OF THE INVENTION

The present invention relates to an improvement in the type of electrical switch generally known as a "dome" switch.

The configurations of various dome switches as now used in the art are exemplified in U.S. Pat. Nos. 4,074,088; 4,042,439; and 3,653,038. Such switches employ a central point contact circumscribed by a circular or nearly circular contact. In many cases, the circular contact is physically, but not electrically, discontinuous. A resilient, electrically conductive dome rests on its edges on the circular contact, and overlies and is spaced from the central contact. The switch is actuated by pressing the center of the dome into physical contact with the central contact to establish an electrical connection between this contact and the circular contact and thereby close the switch.

Dome switches are used in a variety of applications, usually those in which a plurality of relatively inexpensive switches are required. In such applications, the switches can be either mechanically actuated by some device, or manually actuated by the user. An example of a mechanically actuated dome switch is found in video games in which the dome switches are actuated by studs orthogonally disposed about the axis of a controlling joy stick. Manually actuated dome switches are often employed in keyboards for small hand-held calculators.

The principal advantages of the dome switch lies in the simplicity of the parts necessary to construct the switch, and the ease with which the switch can be assembled, particularly as part of an automated assembly process. The dome switch is ideally suited for use in high volume, mass produced, cost competitive items in which several switches must be employed.

A problem which has hampered the use of dome switches in the past is that the life of the switch is very difficult to predict, and such switches are subject to random premature failure. It has been found that when a simple dome switch as described above is employed, the edges or support points of the dome dig into the circular contact when the dome is depressed and released to actuate and deactuate and switch. Such movement can cause premature wear of the anti-oxidation overplating on the second contact, and the switch is subject to unexpected and unpredictable failure at any time. Since such switches are often integral to a complex mechanism involving many parts, failure of the relatively inexpensive dome switch generally requires replacement of the entire mechanism.

SUMMARY OF THE INVENTION

The present invention provides an improved dome switch in which the configuration of the dome is modified to avoid premature wear of the overplating on the circular contact. Specifically, the marginal portions of the dome in physical contact with the circular contact are provided with reverse curvature relative to the curvature of the remainder of the dome.

Because the marginal portions of the dome are reversely curved in the present invention, a smooth surface is presented to the circular contact by the dome.

Movement of the edges of the dome as the switch is actuated and deactuated thus does not cause excessive, unpredictable wear of the circular contact's overplating as has resulted from the sharp edged domes found in the prior art. Accordingly, the possibility of premature failure of the switch caused by wear of the circumscribing contact is virtually eliminated.

In blade switches, the use of a curved contact at the tip of the blade is known in the art, as exemplified in the patent to Peil et al., U.S. Pat. No. 3,705,367. However, such blades are employed only when the blade is normally spaced from the electrical contact. Such curved blades are used primarily to provide a brushing action to clean the electrical contact, and not to avoid premature failure as in the present invention. Use of a reversely curved contact surface in the marginal portion of the dome element of a dome switch, in which the dome is in continuous physical contact with the electrical contact, is not found in the prior art.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
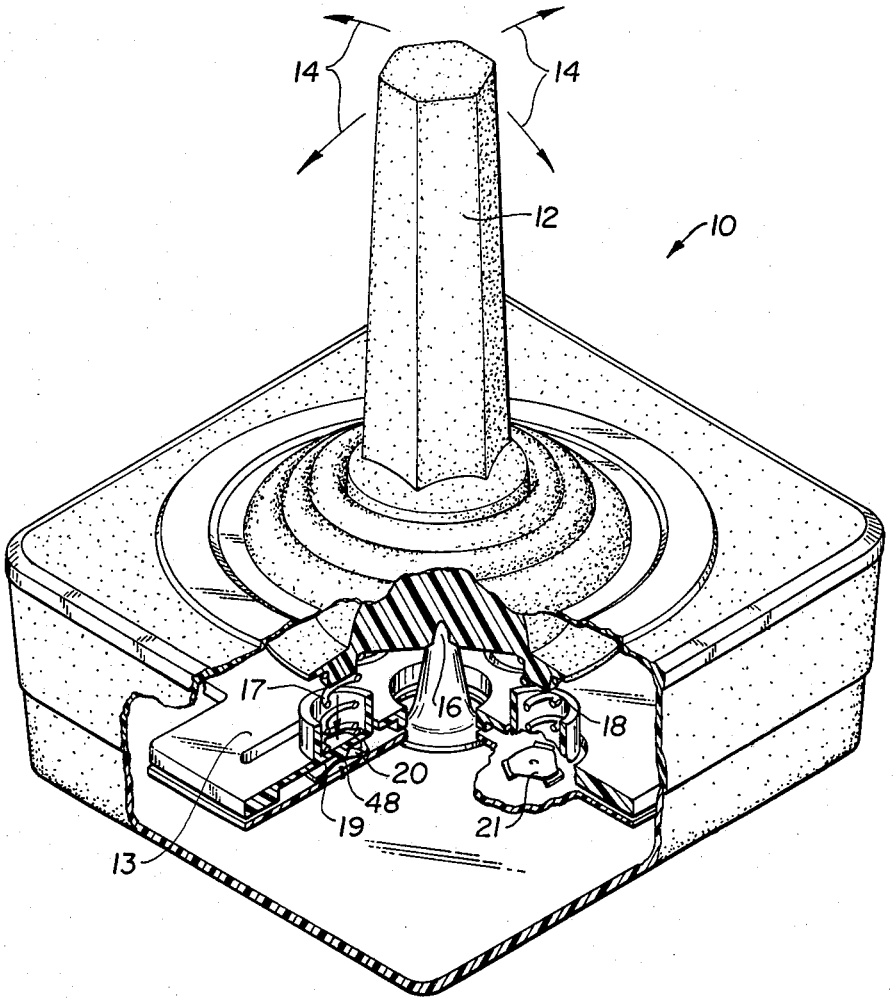
FIG. 1 is a perspective view of a joy stick incorporating the dome switch construction of the present invention.

A joy stick 10 such as that employed in video games is illustrated by way of reference to FIG. 1. Joy stick 10 includes a handle 12 which can be moved by the user as illustrated by arrows 14. Handle 12 is pivoted about a fulcrum 16, and movement of the handle in each orthogonal direction causes one of the springs such as 17, 18 to be compressed. Compression of each spring such as 17 causes downward movement of an underlying flexible armature 19 which is set in plate 13. Dome switches such as 20, 21 underlie each of the armatures 19 and are orthogonally disposed relative to the axis of joy stick handle 12. Depression of the associated armature such as 19 actuates the dome switch, which is used to control movement of an object in the video game.

Figure 2:
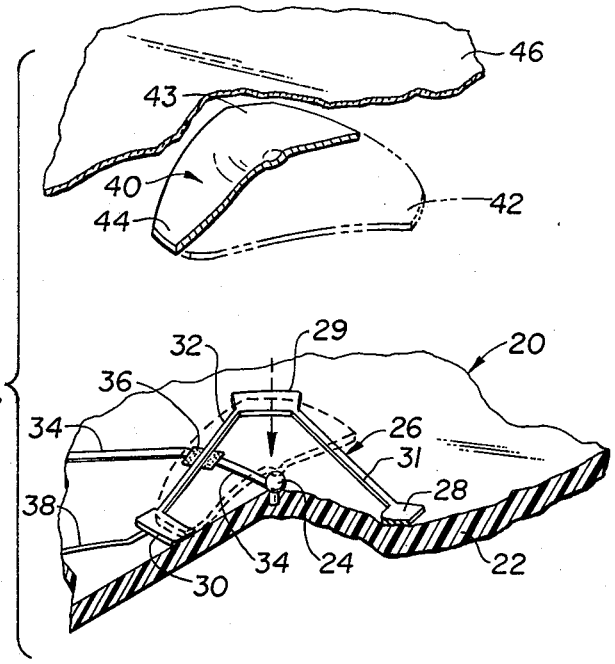
FIG. 2 is an exploded perspective view of one of the dome switches of the present invention as employed in the joy stick of FIG. 1.
Figure 3:
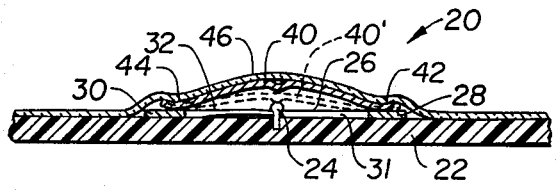
FIG. 3 is a sectional elevation view of the dome switch of FIG. 2.

A representative dome switch such as 20 in the joy stick assembly 10 is illustrated in more detail by way of reference to FIGS. 2 and 3. Switch 20 includes an insulative substrate layer 22, and a point contact 24 bonded to and projecting above the support. A second contact 26 includes three discrete segments 28–30 equally angularly disposed about point contact 24. The contact segments 28–30 are connected by narrow electrically conductive ribs 31, 32 so that the segments provide a single electrical contact.

A conductive lead 34 emanates from point contact 24, and runs along the upper surface of support 22. A thin sheet 36 of insulative material separates lead 34 from rib 32 so that the point contact is electrically isolated from second contact 26. A separate conductive lead 38 runs from second contact 26 to the control mechanism (not shown).

A dome 40 is constructed of electrically conductive material. In switch 20, dome 40 has a roughly triangular shape with each of its marginal portions 42–44 adapted to rest on the respective segments 28–30. A cover 46 overlies dome 40 and is connected to substrate layer 22 to hold the dome in position.

As depicted in FIG. 3, the center portion of dome 40 has a downwardly concave configuration. The marginal portions 42–44 of the dome in contact with segments 28–30 of second contact 26 have an upwardly concave configuration. As a result, the smooth curved surface on the underside of marginal portions 42–44 of dome 40 is in physical contact with second contact 26.

As discussed previously, switch 20 is actuated by downward movement of flexible armature 19. Referring back to FIG. 1, armature 19 includes an underlying stud portion 48 which rests on the top of dome 40. When armature 19 is depressed, stud 48 moves downwardly to bias the center portion of dome 40 into physical contact with point contact 24, as illustrated by the dash lines 40' in FIG. 3.

Downward movement of dome 40 causes corresponding lateral movement of marginal portions 42–44 of the dome. Such transverse movement has caused problems in the dome switches used in the past because it often causes excess wear of contact 26 and precipitates premature failue of the switch, particularly since the thickness of segments 28–30 is very small on the order of only a few microns. This problem is avoided in the present invention by the reverse curvature of the marginal portions 42–44 of dome 40 which eliminates such premature wear.

Figure 4:
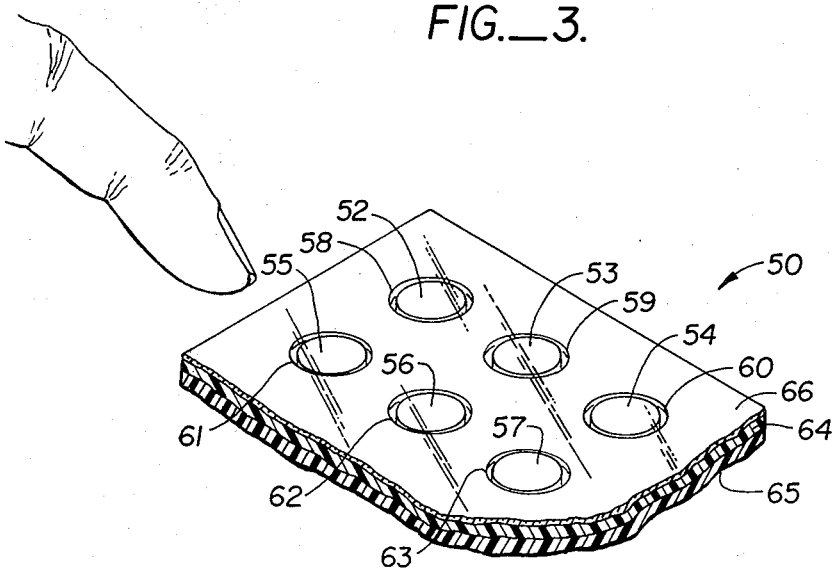
FIG. 4 is a fragmentary perspective view of a keyboard employing multiple dome switches constructed according to the teachings of the present invention.

An example of the use of dome switch in a keyboard 50 such as that found in a handheld calculator is illustrated by way of reference to FIG. 4. Keyboard 50 includes a plurality of dome switches such as 52–57 mounted in circular apertures 58–63 in a supporting plate 64. A flexible transparent cover 66 overlies plate 64 and sheet 65 underlies the plate to hold dome switches 52–57 in position.

Figure 5:
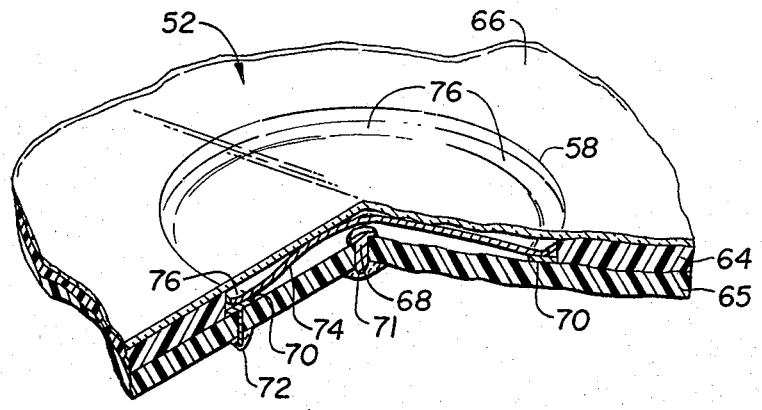
FIG. 5 is a fragmentary perspective view of one of the domes switches of FIG. 4.
Figure 6:
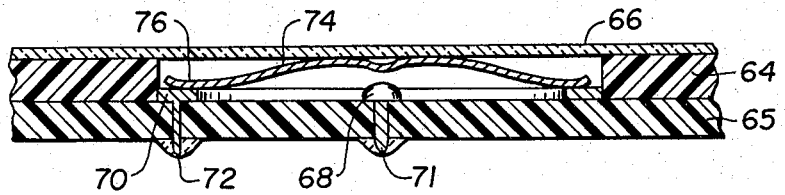
FIG. 6 is a sectional elevation view of the dome switch of FIG. 5.

The construction of one of the dome switches 52 in keyboard 50 is illustrated by way of reference to FIGS. 5 and 6. Dome switch 52 includes a point contact 68 centered in aperture 58. A circular or nearly circular contact 70 circumscribes point contact 68 and is located in the outer periphery of aperture 58. Both contact 68 and contact 70 include extensions 71, 72 respectively projecting below sheet 65 for connection to a circuit board.

A generally circular dome 74 rests on its marginal portion 76 on circular contact 70. Marginal portion 76 of dome 74 has reverse curvature relative to the dome itself. In this fashion, a smooth surface on dome 74 is in physical contact with circular contact 70 so that excessive wear of the circular contact is avoided.

In dome switch 20 used in joy stick 10, dome 40 is roughly triangular, and is supported by contact 26 comprising three discrete segments 28–30. In dome switch 52, used in keyboard 50, dome 40 and supporting contact 70 are circular or nearly so. However, in each case the marginal portions of the dome which rest on the contact have reverse curvature to avoid premature wear of the contact.

While preferred embodiments of the present invention have been illustrated in detail, it is apparent that modifications and adaptations of those embodiments will occur to those skilled in the art. It is to be expressly understood, however, that such modifications and adaptations are within the spirit and scope of the present invention, as set forth in the following claims.

What is claimed is:

1. A dome switch comprising:

an insulating substrate;

a first electrical contact on the substrate;

a second electrical contact provided by a region of electrically conductive material disposed on the substrate at least partially circumferentially about the first electrical contact;

a resilient electrically conductive plate having a central dome shaped portion and a peripheral portion substantially all of which is reversely curved relative to the dome shape, at least one selected portion of the peripheral portion being normally in physical contact with the second electrical contact to provide both mechanical support for said plate and electrical connection with said second electrical contact; and wherein the central dome shaped portion of the conductive plate is spaced from and overlies the first electrical contact so that actuation of the conductive plate moves the central dome shaped portion into electrical contact with the first electrical contact to thereby electrically connect the first electrical contact to the second electrical contact.

2. A dome switch as in claim 1 wherein:

the second electrical contact is centered about the first electrical contact; and a strip of conductive material on the substrate connects the first electrical contact to regions outside the second electrical contact.

3. A dome switch as in claim 1 wherein a layer of flexible insulating material is formed over the insulating substrate and over the conductive plate to thereby hold the conductive plate in alignment with the second electrical contact.

4. In a dome switch which includes an insulating substrate, a first electrical contact on the substrate, a second electrical contact provided by a region of electrically conductive material disposed on the substrate at least partially circumferentially about the first electrical contact, a resilient electrically conductive plate having a central dome shaped portion spaced from and overlying the first electrical contact at least one selected portion of the periphery of which is in electrical contact with the second electrical contact, whereby depressing the conductive plate moves the central dome shaped portion into electrical contact with the first electrical contact to thereby electrically connect the first electrical contact to the second electrical contact, the improvement wherein the conductive plate has a peripheral portion substantially all of which is in mechanical and electrical contact with the second electrical contact, said peripheral portion being reversely curved with respect to the central dome shaped portion.

5. A dome switch as in claim 4 wherein:

the second electrical contact is centered about the first electrical contact; and a strip of conductive material connects the first electrical contact to regions outside the second electrical contact.

6. A dome switch as in claim 4 wherein a layer of flexible insulating material is disposed over the insulating substrate and over the conductive plate to thereby hold the conductive plate in alignment with the second electrical contact.

* * * * *

UNITED STATES PATENT AND TRADEMARK OFFICE

CERTIFICATE OF CORRECTION

PATENT NO. : 4,319,099

DATED : March 9, 1982

INVENTOR(S) : James C.Asher

It is certified that error appears in the above–identified patent and that said Letters Patent are hereby corrected as shown below:

In the Abstract, line 4, change "is" to --in--.

Column 1, line 35, change "lies" to singular.

Column 3, line 40 change "failue" to --failure--.

Signed and Sealed this

*Fifteenth* Day of *June 1982*

[SEAL]

*Attest:*

GERALD J. MOSSINGHOFF

*Attesting Officer*

*Commissioner of Patents and Trademarks*